US005461899A

United States Patent [19]

Sørheim et al.

[11] Patent Number: 5,461,899

[45] Date of Patent: Oct. 31, 1995

[54] SEALING DEVICE FOR AN EXTRUDER

[75] Inventors: Ole Johan Sørheim, Torjulvågen; Kai Magne Vik, Nesbru; Lars Auran, Sunndalsøra, all of Norway

[73] Assignee: Norsk Hydro a.s., Oslo, Norway

[21] Appl. No.: 98,395

[22] PCT Filed: Dec. 7, 1992

[86] PCT No.: PCT/NO92/00191

§ 371 Date: Aug. 26, 1994

§ 102(e) Date: Aug. 26, 1994

[87] PCT Pub. No.: WO93/11887

PCT Pub. Date: Jun. 24, 1993

[30] Foreign Application Priority Data

Dec. 10, 1991 [NO] Norway ..... 914844

[51] Int. Cl.[6] ..... B21C 27/04

[52] U.S. Cl. ..... 72/272; 72/253.1

[58] Field of Search ..... 72/253.1, 272, 72/273

[56] References Cited

U.S. PATENT DOCUMENTS

| | | | |
|---|---|---|---|
| 2,107,896 | 2/1938 | MacKnight | 72/273 |
| 3,369,384 | 2/1968 | Beneke et al. . | |
| 3,705,509 | 12/1972 | Haller | 72/253.1 |
| 3,779,063 | 12/1973 | Gannon | 72/253.1 |
| 3,835,685 | 9/1974 | Kent et al. . | |
| 4,714,423 | 12/1987 | Hattori et al. | 72/273 |

FOREIGN PATENT DOCUMENTS

| | | |
|---|---|---|
| 2036199 | 12/1970 | France . |
| 2400973 | 3/1979 | France . |
| 930984 | 7/1955 | Germany . |
| 953247 | 11/1956 | Germany . |
| 1348022 | 10/1987 | U.S.S.R. . |

*Primary Examiner*—Lowell A. Larson
*Attorney, Agent, or Firm*—Wenderoth, Lind & Ponack

[57] ABSTRACT

An extruder with an air evacuation mechanism includes a cylinder with a die mounted at an outlet end and a piston movable between a position outside an opposite inlet end and a position inside the cylinder. A separate sealing device is mounted at the inlet end and accompanies the piston when it is retracted from the cylinder. The sealing device includes a casing with sealing rings mounted on the piston or a piston rod thereof.

17 Claims, 1 Drawing Sheet

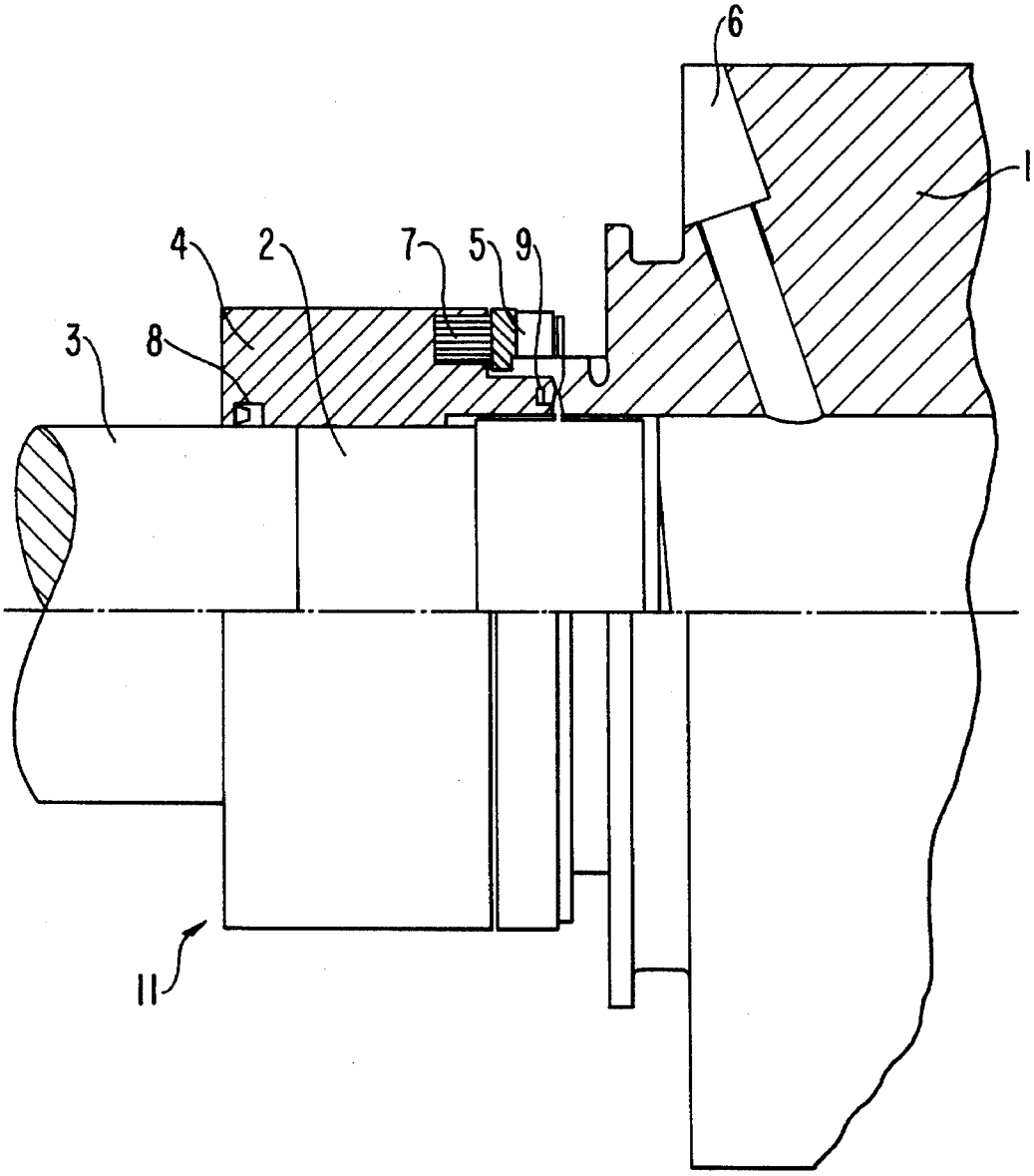
6
1
4
2
7
5
9
3
8
11

SEALING DEVICE FOR AN EXTRUDER

BACKGROUND OF THE INVENTION

The present invention relates to a sealing device for an extruder for the evacuation of air, the extruder including a cylinder with a die and a reciprocating piston.

In the production of longitudinal metal sections by the traditional method, a shaping machine of the above type is used. A metal billet with a circular cross-section is preheated and placed in the cylinder. Then the piston presses the billet through the die with great force. The extrusions thus formed take on different shapes depending on the shape of the hole in the die.

Work is being done to develop methods of producing metal sections based on the use of particulate material such as metal powder or needles. However, when one uses particulate material to make a bolt or metal extrusion, there are increased problems with air pockets and moisture, and this detracts form the quality of the extrusion.

EP Patent Application No. 0397423 describes a method and equipment for producing metal objects by consolidation of particulate material, using an extruder with a solution for the evacuation of gas. A piston is used with a wedge, where the gas is sucked out past the wedge and through a bore in the piston. This solution gives an end product which is very close to optimum, i.e. which to all intents and purposes is without deleterious impurities and pores, and which has an almost impermeable surface which prevents absorption of humidity and gas during later use. However, there is one disadvantage with such equipment, i.e. that it does not achieve a satisfactory seal between the piston and the cylinder, and this in turn means that air is drawn into the cylinder during the extraction operation when a strong vacuum is used.

Also known is an extruder where air is extracted from the extruder cylinder by means of a venting plate which is pressed against a venting ring mounted on the cylinder. The venting plate can be moved by means of piston/cylinder mechanisms. This solution is complicated and costly. In addition, it requires a great deal of space and would obstruct the movements of anyone operating it.

SUMMARY OF THE INVENTION

The present invention provides a sealing device for an extruder which provides an almost complete seal, and which, combined with the use of an efficient vacuum pump, can provide pressures lower than $10^{-3}$ atm. The pressure can be further reduced by using a molecular or diffusion pump.

With this invention there is provided a sealing mechanism for an extruder wherein a separate sealing mechanism is installed at the inlet, which sealing mechanism accompanies the piston when it is retracted from the cylinder.

BRIEF DESCRIPTION OF THE DRAWING

The invention will now be described in more detail by means of an example and with reference to the attached drawing, wherein:

The single FIGURE is a partial cross-section of an extruder according to the invention.

DETAILED DESCRIPTION OF THE INVENTION

The extruder of the invention includes a cylinder 1, a piston 2, and a sealing device 11. A die of the extruder, equipment for feeding particulate material and a hydraulic arrangement for moving the piston are not shown in the drawing and will not be discussed in more detail. The cylinder 1 is provided with a generally radial hole or bore 6 that extends axially inclined from another end thereof to an inner end thereof opening into the cylinder 1. The bore 6 is furnished with a threaded steel pipe (not shown) which in turn is connected with a vacuum pump (not shown).

To obtain a seal between the cylinder and a piston rod 3, sealing device 11 is installed outwardly of the piston rod 3 and the piston 2. Device 11 includes a casing 4, mainly of aluminum, furnished with an inside seal 8 sealing against the piston rod 3 and a V-shaped ring 9 of heat-resistant material sealing against an end of the cylinder 1. On the front of casing 4 a series of permanent magnets 7 is attached against the cylinder 1. The permanent magnets keep the casing 4 centered, i.e. in position in relation to the cylinder 1 until a vacuum arises in the cylinder in connection with an extraction operation. This helps to press the casing 4 against the wall of cylinder 1 around the cylinder opening. In addition, the permanent magnets, or rather the force they exert, will help to make the piston 2, during its return movement, wedge in an inside on cone (sealing device and inside cone not shown in the figure) on the casing 4 and will withdraw it to the starting position. To improve the seal and reduce wear on the sealing ring 8, a lubrication arrangement (not shown) is provided for the casing, which ensures that lubrication oil is supplied to the area at the sealing ring. In addition, to prevent loss of magnetic force at temperatures over 200° C., a water-cooled steel ring 5 is provided on the cylinder, against which the magnets impact.

The evacuation device operates in the following manner. As long as the piston rod 3 with the piston 2 is outside the cylinder 1, the casing 4 with the magnets 7 will be wedged firmly to the piston 2. After the cylinder has been charged with a billet or particulate material, the piston rod 3 with the piston 2 is inserted in the cylinder 1. The casing 4 will be "held" in position by the magnets 7 as shown in the drawing, the air/gas can now be evacuated from the cylinder through the vent bore 6. As such air/gas is evacuated, a tighter seal is obtained between the cylinder/casing and piston/casing respectively through the sealing rings 9 and 8, and the casing will, as mentioned above, be pressed against the cylinder. Trails have shown that a 100% seal is achieved for a pressure of $10^{-3}$ atm. At the end of the evacuation operation the piston with piston rod move on into the cylinder until the extrusion cycle has been completed.

The evacuation mechanism as described in accordance with this invention was in principle developed for use in connection with the evacuation of air/gas when extruding particulate material. However, the mechanism of the invention also can be used to evacuate air when extruding billets, and further can be used in connection with an extruder to evacuate gas through the piston as mentioned in the above discussed EP patent application.

We claim:

1. An extruder for the extrusion of metal such as aluminum, said extruder comprising:

a cylinder having an inlet end opposite an outlet end to be provided with a die;

a piston supported by a piston rod and movable thereby between a withdrawn position, whereat said piston is outwardly of the interior of said cylinder, and an extruding position, whereat said piston is within said interior of said cylinder;

a sealing device mounted to, when said piston is in said interior of said cylinder, provide a seal between said piston and said cylinder, said sealing device being movable with said piston when said piston is moved to said withdrawn position; and a bore leading through said cylinder from an inward end at said interior to an outward end at a position on said cylinder exterior of sealing cooperation between said sealing device and said cylinder.

2. An extruder as claimed in claim 1, wherein said sealing device includes a casing mounted annularly about said piston or said piston rod.

3. An extruder as claimed in claim 2, wherein said sealing device further includes a sealing ring mounted on said casing and sealing inwardly against said piston or said piston rod.

4. An extruder as claimed in claim 3, wherein said sealing device further includes another sealing ring mounted on said casing and sealing axially against a surface of said inlet end of said cylinder when said piston is within said interior thereof.

5. An extruder as claimed in claim 4, further comprising at least one magnet mounted on said casing and operable to urge said casing toward said cylinder and thereby to urge said another sealing ring into sealing contact with said surface.

6. An extruder as claimed in claim 5, wherein said at least one magnet comprises plural permanent magnets.

7. An extruder as claimed in claim 6, further comprising a water-cooled ring mounted on said inlet end of said cylinder to prevent loss of magnetic properties thereof.

8. An extruder as claimed in claim 7, wherein said water-cooled ring is formed of magnetic material and is positioned to be abutted by said permanent magnets.

9. An extruder as claimed in claim 4, wherein said position of said outward end of said bore is annularly outwardly of contact of said another sealing ring with said cylinder.

10. An extruder as claimed in claim 9, wherein said bore inclines axially toward said inlet end.

11. An extruder as claimed in claim 2, wherein said sealing device further includes a sealing ring mounted on said casing and sealing axially against a surface of said inlet end of said cylinder when said piston is within said interior thereof.

12. An extruder as claimed in claim 11, further comprising at least one magnet mounted on said casing and operable to urge said casing toward said cylinder and thereby to urge said sealing ring into sealing contact with said surface.

13. An extruder as claimed in claim 12, wherein said at least one magnet comprises plural permanent magnets.

14. An extruder as claimed in claim 13, further comprising a water-cooled ring mounted on said inlet end of said cylinder to prevent loss of magnetic properties thereof.

15. An extruder as claimed in claim 14, wherein said water-cooled ring is formed of magnetic material and is positioned to be abutted by said permanent magnets.

16. An extruder as claimed in claim 2, wherein said position of said outward end of said bore is annularly outwardly of contact of said sealing ring with said cylinder.

17. An extruder as claimed in claim 16, wherein said bore inclines axially toward said inlet end.

* * * * *